United States Patent [19]

Meyerson

[11] Patent Number: 4,769,963

[45] Date of Patent: Sep. 13, 1988

[54] BONDED PANEL INTERLOCK DEVICE

[75] Inventor: Steven C. Meyerson, Largo, Fla.

[73] Assignee: Structural Panels, Inc., Oldsmar, Fla.

[21] Appl. No.: 71,245

[22] Filed: Jul. 9, 1987

[51] Int. Cl.[4] ..... E04B 1/80; E04C 1/14

[52] U.S. Cl. ..... 52/309.9; 52/404; 52/588; 52/592; 52/595

[58] Field of Search ..... 52/588–595, 52/309.9, 309.11, 795, 802, 806, 404

[56] References Cited

U.S. PATENT DOCUMENTS

| | | | |
|---|---|---|---|
| 2,682,938 | 7/1954 | MacDonald | 52/404 |
| 3,367,076 | 2/1968 | O'Brien | 52/309.11 |
| 3,479,784 | 11/1969 | Massagli | 52/309.11 |
| 3,742,672 | 7/1973 | Schaeufele | 52/594 |
| 3,760,548 | 9/1973 | Sauer et al. | 52/593 |
| 4,186,539 | 2/1980 | Harmon et al. | 52/582 |
| 4,373,312 | 2/1983 | Kim | 52/309.9 |

FOREIGN PATENT DOCUMENTS

| | | | |
|---|---|---|---|
| 2444762 | 7/1980 | France | 52/594 |
| 1066701 | 4/1967 | United Kingdom | 52/593 |

*Primary Examiner*—James L. Ridgill, Jr.
*Attorney, Agent, or Firm*—Herbert W. Larson

[57] ABSTRACT

A building panel providing for structural and insulating integrity between adjacent modular construction panels is formed from two sheets of thin metal bonded to a styrofoam core. One longitudinal edge of the panel has a first pair of shaped ramp and groove interlock elements with a shaped wedge of core projecting outwardly between these first pair of elements. A second longitudinal opposite edge of the panel has a second pair of U-shaped interlock elements with a shaped cup-like edge of the core conforming to the wedge on the opposite side and overlapped by the second pair of U-shaped interlock elements. Adjacent panels are snapped together by moving the U-shaped interlock elements over the ramp and into the groove of the first pair of interlock elements to form a tight fit and causing the edges of the core to have a tight edge to edge insulating seal.

5 Claims, 2 Drawing Sheets

BONDED PANEL INTERLOCK DEVICE

BACKGROUND OF THE INVENTION

1. Field of the Invention

This invention relates to construction panels for building sidewalls and overhead members. More particularly it refers to male and female interlock devices on opposite sides of a panel for cooperative locking with adjacent modular panels of like structure.

2. Description of the Prior Art

Interlock mechanisms for joining building panels together for ease of modular assembly are known from U.S. Pat. Nos. 3,367,076; 3,479,784; 3,742,672; 3,760,548; and 4,373,312. Although each of these patents shows unique interlock mechanisms and methods of bonding thin skin panels together, no single reference describes a simple interlock resulting in a tight edge to edge fit of the intermediate styrofoam insulating layer. A panel interlock device is needed to provide such a tight edge to edge fit for the insulating layer and at the same time provide a quick snap retention of the panels in a side by side relationship.

SUMMARY OF THE INVENTION

I have invented an interlocking panel mechanism with matching edge to edge mating of the intermediate insulating layer. My panel is a rigid wall building structure having substantially parallel planar front and rear thin metal sheets separated by an insulating rigid foam core bonded to the inner side of the metal sheets.

One longitudinal edge of the panel has a first pair of shaped ramp and groove interlock elements, each projecting from one of the thin metal sheets with a shaped wedge of foam core projecting outwardly between the pair of ramp and groove interlock elements.

A second opposite longitudinal edge of the panel has a second pair of U-shaped interlock elements each projecting from one of the thin metal sheets with an indentation in the foam core conforming to the wedge of foam core projecting outwardly from an adjacent panel.

Adjacent panels are locked together by sliding the U-shaped interlock elements from one panel over the ramp and into the groove of an adjacent panel. The foam core from adjacent panels meet in an edge to edge configuration as the respective interlock elements are snapped together. The other side ends of the panel are mounted in U-channels affixed to a building frame structure so that the panels can be mounted in a side by side relationship to form a wall. Alternatively, the panels can be mounted in the same manner in U-channels affixed to the building overhead to form a ceiling structure.

BRIEF DESCRIPTION OF THE DRAWINGS

The present invention may be best understood by those having ordinary skill in the art by reference to the following detailed descriptions with the accompanying drawings in which.

DETAILED DESCRIPTION OF THE PREFERRED EMBODIMENT

Figure 2:
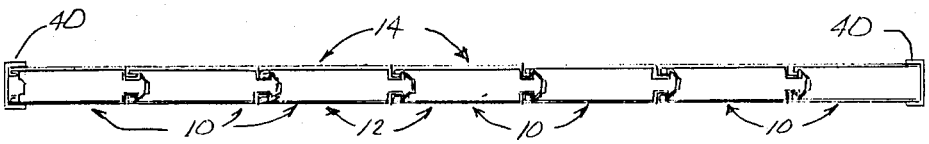
FIG. 2 is a plan view of a series of wall panels interlocked together.
Figure 1:
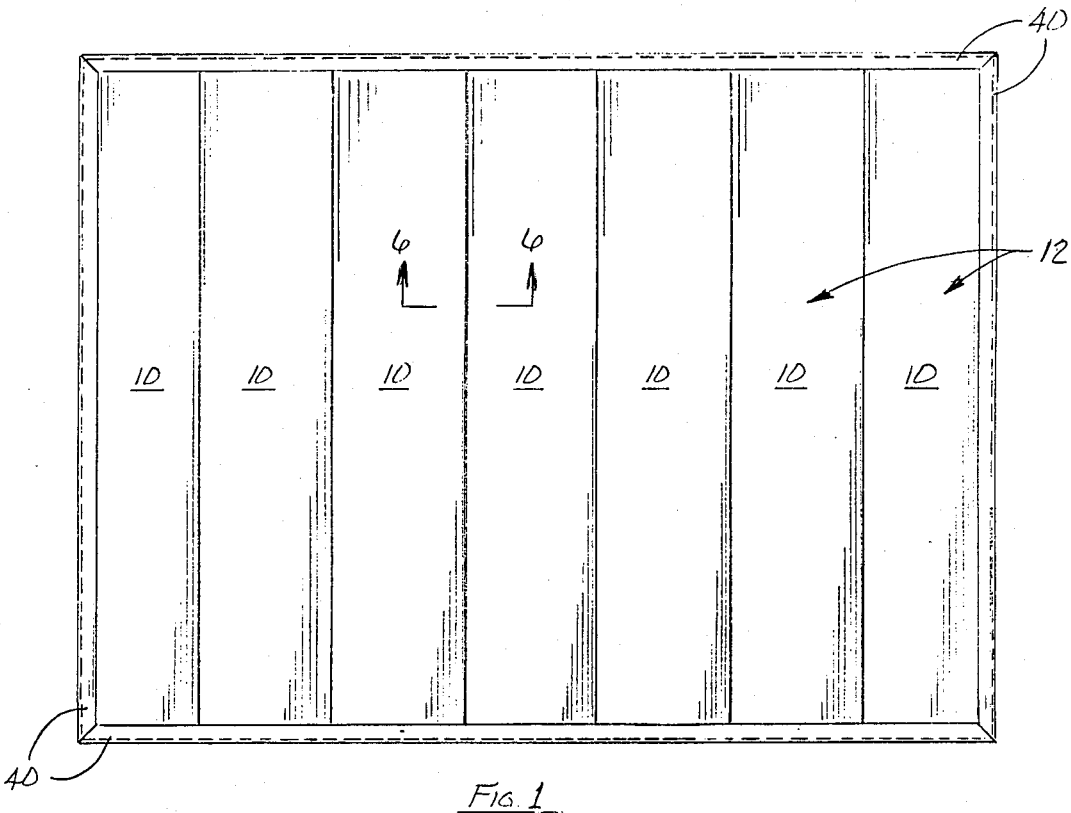
FIG. 1 is an elevation view of panels of this invention mounted as a wall.

Throughout the following detailed description the same reference numerals refer to the same elements in all figures.

Rigid building panel 10 has substantially parallel, planar front 12 and rear 14 sheets with an insulating rigid foam core 16 bonded to the two sheets. In a ceiling panel the top sheet conforms to front 12 and the bottom sheet to rear 14. The core 16 has a first pair of oppositely facing ends having straight edges, 18 and 20 respectively. In addition, the core 16 has a second pair of oppositely facing longitudinal complimentary edges 22 and 24 respectively. Edge 22 has an inwardly projecting dish-like geometric configuration and edge 24 has an outwardly projecting element conforming to the space within the dish-like geometric configuration of edge 22.

Each sheet 12 and 14 has a first pair of oppositely facing ends having straight edges 26 and 28 conforming to edges 18 and 20 respectively in the core 16. In addition each sheet has a second pair of oppositely facing edges 30 and 32 respectively. Edge 30 is an interlock element formed by turning down and curling under one edge of panel sheets 12 and 14 to form a pair of U-shaped structures 34. The opposite edge 32 is formed by turning down and curling the metal outwardly to form an outward U-shaped channel 36 with an integral outwardly projecting ramp 38.

Figure 3:
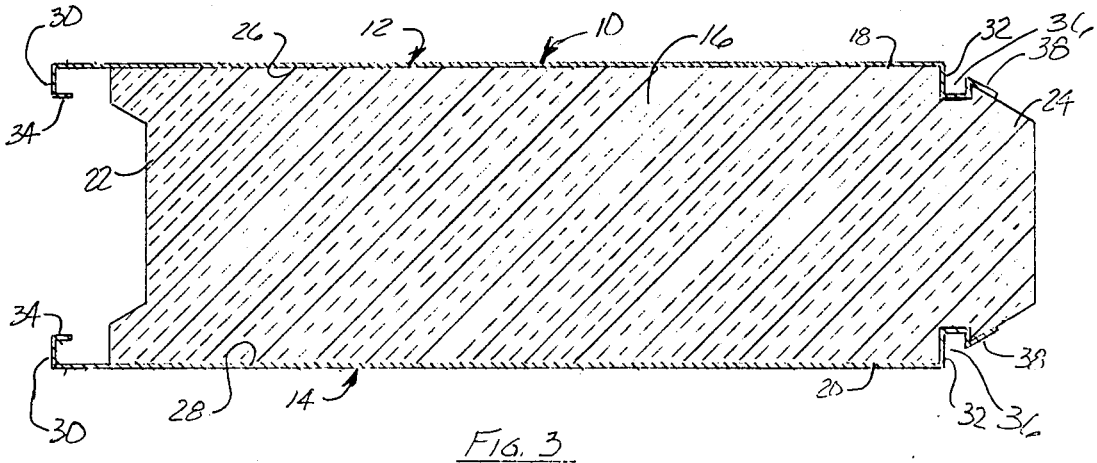
FIG. 3 is an end view in elevation of a panel.
Figure 4:
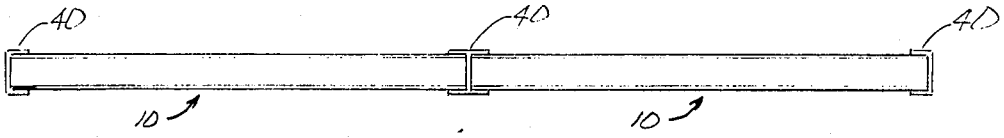
FIG. 4 is an elevation view of panels of this invention mounted as a ceiling.
Figure 5:
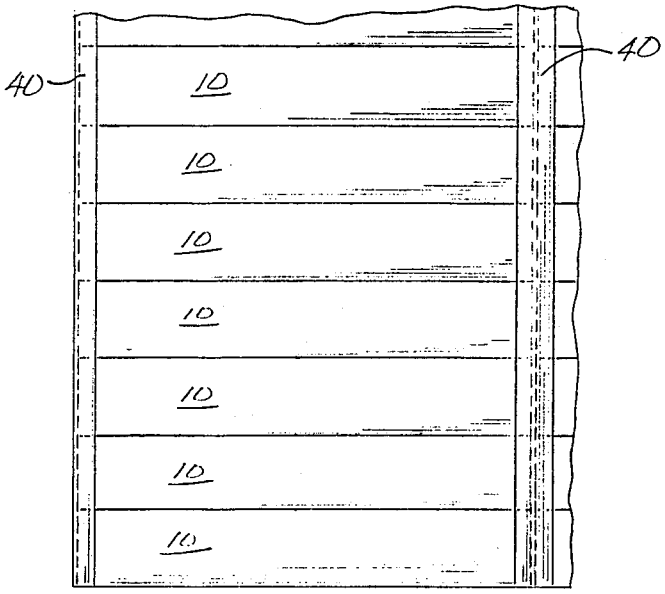
FIG. 5 is a plan view of a series of ceiling panels interlocked together.
Figure 6:
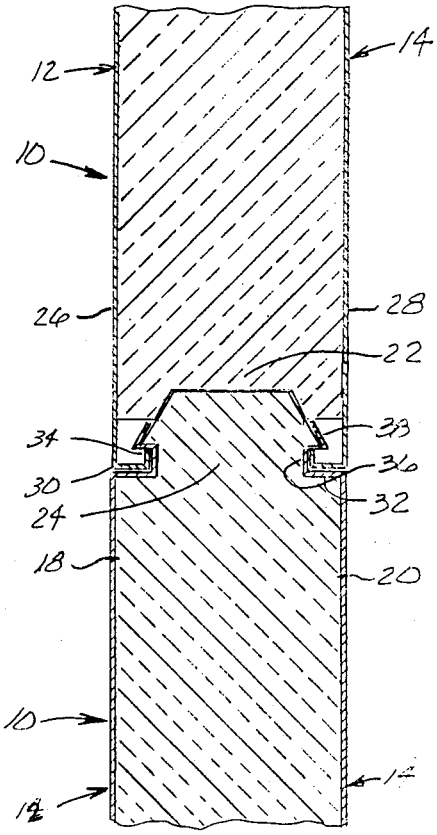
FIG. 6 is a sectional view along 6—6 of FIG. 1 showing the position of the interlock elements and core between adjacent panels.
Figure 7:
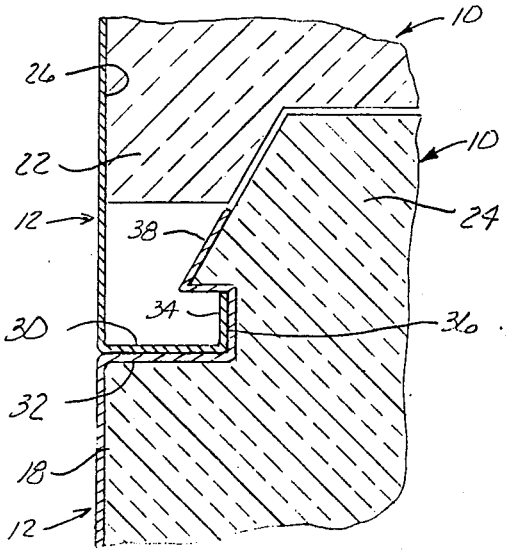
FIG. 7 is an enlarged view of the interlock elements of this invention.

Edge 22 of core 16 is located between identical interlock elements 30 of sheets 12 and 14. Interlock elements 30 overlap edge 22 by about one-half inch as seen in FIG. 3. The edge 24 of core 16 projects outwardly between identical edges 32 of sheets 12 and 14 by about one-half inch. When adjacent panels are locked together edge 30 rides up and over ramp 38 and snaps into channel 36 of edge 32. At the same time edges 22 and 24 of the core abut to form a tight insulating structure.

Optimally, a thin bead of caulk may be inserted in the interlock zone between adjacent panels to provide a more perfect insulation shield.

Sheets 12 and 14 are made from about 0.019" to 0.024" thick aluminum. The core 16 is a commerical insulating grade polystyrene or styrofoam about one to eight inches thick. The preferred thickness is three inches. The core 16 is bonded on each side to sheet 12 and 14 respectively with glue or a standard contact adhesive.

A receiver channel 40 is nailed or screwed to either the overhead beams or side wall structure of a building depending upon how the panel will be used. The panel ends are slid into the channels 40 and then the interlock elements are snapped together by a pushing motion.

The panels 10 are of a length and width as required for each specific construction requirement. Since the invention resides in the interlock fit between adjacent panels it is not necessary to describe all the variations in panel sizes. However, a common preferred size would be four feet by eight feet.

The core material 16 can be made from either an insulating material or non-insulating material depending on the desired use. In most instances the core 16 will be an insulating material such as polystyrene, styrofoam or like material.

The interlock edges 30 or 32 of the panel 10 can be formed by a simple bending operation during extrusion of the thin metal sheets 12 and 14.

The panel construction of this invention, through the use of edges 30 and 32, provides a means of dimensionally locating each panel 10 relative to the next adjacent panel and at the same time provide structural integrity at the joint between the two panels. The configuration of the core between the interlocking joints insures good insulating properties.

The novel interlock feature of this invention enables close dimensional tolerances between adjacent panels and adds to the structural strength of either a ceiling or wall formed from these panels.

Having thus described the invention, what is claimed and desired to be secured by Letters Patent is:

1. In a rigid building panel with substantially parallel planar front and rear metal sheets separated by an insulating rigid foam core bonded to the sheets and having a first pair of opposite parallel and substantially straight end edges, the improvements comprising a second pair of opposite longitudinal edges having complimentary first and second interlocking elements forming the longitudinal edge of each metal sheet, the first interlocking element forming a U-shaped projection along matching edges of the front and rear metal sheets with a first core edge between the first interlocking elements having an inwardly projecting dish-shaped geometric configuration, the second interlocking element forming a ramp and a groove behind the ramp along matching edges of the front and rear metal sheets with a second core edge between the second interlocking elements having an outwardly projecting geometric shape conforming to the dish-shaped geometric configuration of the first core edge, the first interlocking U-shaped projections on the second pair of edges of the metal sheets capable of sliding over the ramp of the second interlocking elements and snapping in place in the groove behind the ramp forming a tight interlock fit and forming an edge to edge insulating fit between the first and second core edges.

2. A rigid building panel according to claim 1 wherein the panel is snapped together with an adjacent panel in a channel affixed to a building overhead structure to form a ceiling.

3. A rigid building panel according to claim 1 wherein the panel is snapped together with an adjacent panel in a channel affixed to a building side wall structure to form an exterior wall.

4. A rigid building panel according to claim 1 wherein the metal sheets are light-weight aluminum.

5. A rigid building panel according to claim 1 wherein the core is an insulating styrofoam sheet.

* * * * *

UNITED STATES PATENT AND TRADEMARK OFFICE

CERTIFICATE OF CORRECTION

PATENT NO. : 4,769,963

DATED : September 13, 1988

INVENTOR(S) : Steven C. Meyerson

Figure 8:
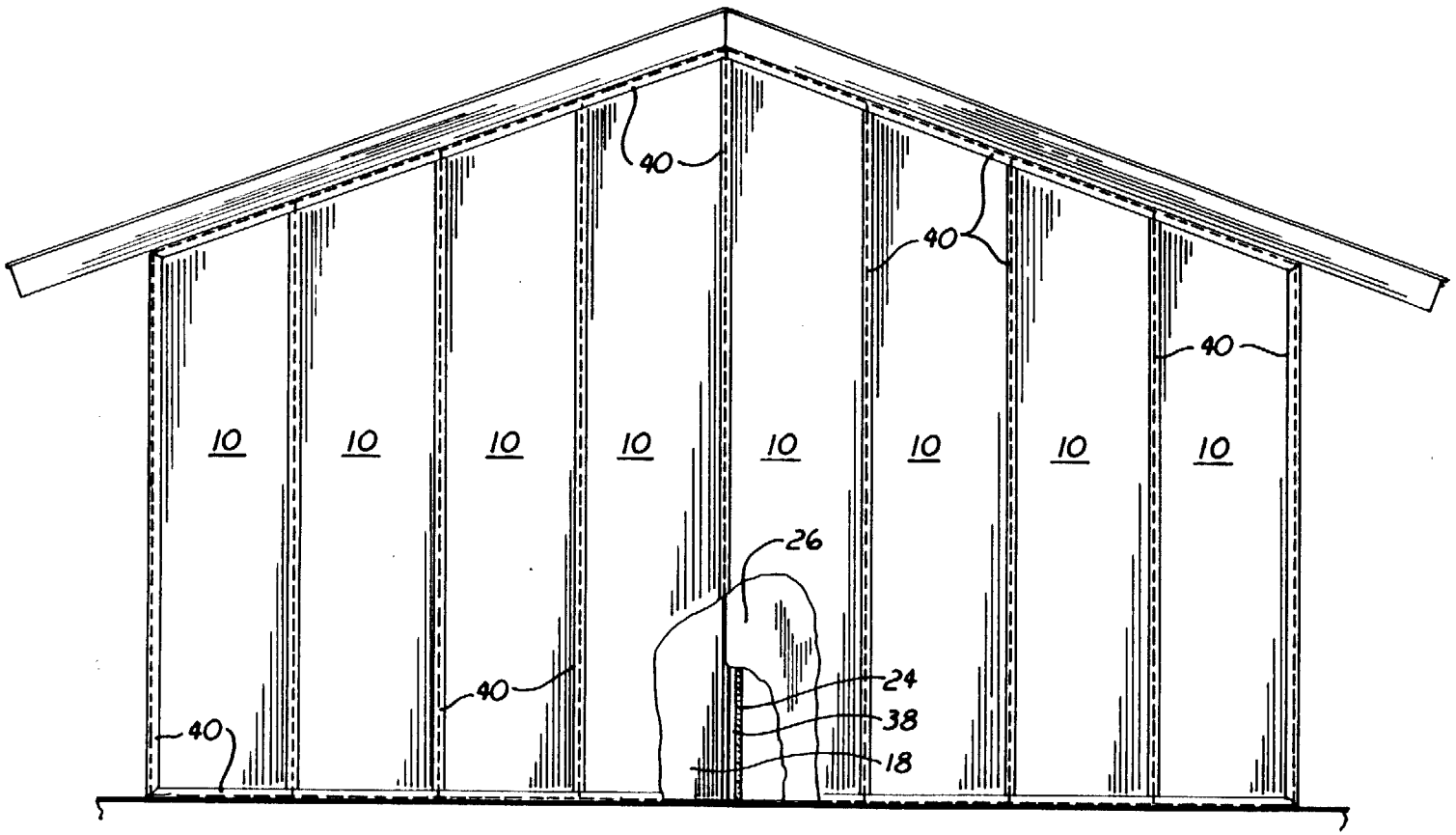
FIG. 8 is an elevation view of a side of a house showing the erected panels.

It is certified that error appears in the above-identified patent and that said Letters Patent is hereby corrected as shown below:

The sheet of Drawing consisting of Figure 8 should be added as per attached sheet.

Signed and Sealed this

Sixth Day of February, 1990

*Attest:*

JEFFREY M. SAMUELS

*Attesting Officer*

*Acting Commissioner of Patents and Trademarks*

REEXAMINATION CERTIFICATE (1553rd)

United States Patent [19] [11] B1 4,769,963

Meyerson [45] Certificate Issued Sep. 10, 1991

[54] BONDED PANEL INTERLOCK DEVICE

[75] Inventor: Steven C. Meyerson, Largo, Fla.

[73] Assignee: Republic Bank

Reexamination Request:
No. 90/002,027, May 16, 1990

Reexamination Certificate for:

| | |
|---|---|
| Patent No.: | **4,769,963** |
| Issued: | **Sep. 13, 1988** |
| Appl. No.: | **71,245** |
| Filed: | **Jul. 9, 1987** |

[51] Int. Cl.[5] ..... E04B 1/80; E04C 1/14

[52] U.S. Cl. ..... 52/309.9; 52/404; 52/588; 52/592; 52/595

[58] Field of Search ..... 52/779, 593, 309.4, 52/309.9, 592, 595, 588, 404, 309.8

[56] References Cited

U.S. PATENT DOCUMENTS

| | | | |
|---|---|---|---|
| 3,293,812 | 12/1966 | Hammitt | 52/779 |
| 3,605,363 | 9/1971 | Bard | 52/588 |
| 4,402,167 | 9/1983 | Denucci | 52/127.5 |

FOREIGN PATENT DOCUMENTS

| | | | |
|---|---|---|---|
| 1274927 | 5/1972 | United Kingdom | 52/731 |
| 2142670 | 1/1985 | United Kingdom | 52/593 |
| 2168732 | 6/1986 | United Kingdom | 52/309.9 |

*Primary Examiner*—James Lee Ridgill, Jr.

[57] ABSTRACT

A building panel providing for structural and insulating integrity between adjacent modular construction panels is formed from two sheets of thin metal bonded to a styrofoam core. One longitudinal edge of the panel has a first pair of shaped ramp and groove interlock elements with a shaped wedge of core projecting outwardly between these first pair of elements. A second longitudinal opposite edge of the panel has a second pair of U-shaped interlock elements with a shaped cup-like edge of the core conforming to the wedge on the opposite side and overlapped by the second pair of U-shaped interlock elements. Adjacent panels are snapped together by moving the U-shaped interlock elements over the ramp and into the groove of the first pair of interlock elements to form a tight fit and causing the edges of the core to have a tight edge to edge insulating seal.

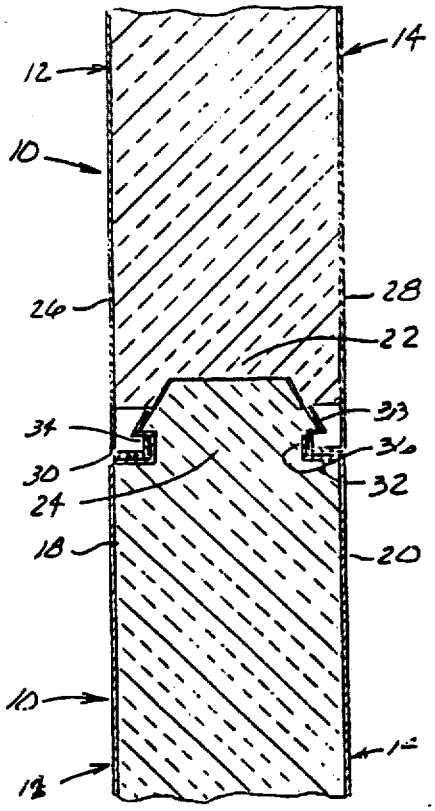

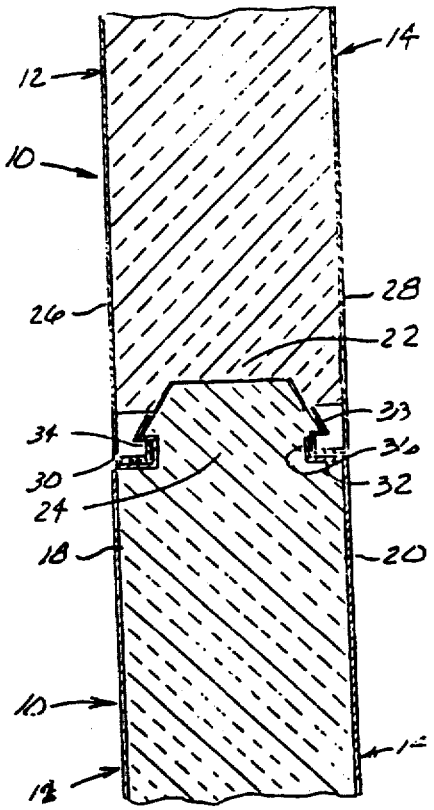
14
12
10
28
26
22
33
34
36
30
32
24
18
20
10
14
18

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDENT ARE PRINTED HEREIN.

Column 2, lines 39–47:

Edge 22 of core 16 is located between identical interlock elements 30 of sheets 12 and 14. Interlock elements 30 overlap edges 22 by about one-half inch as seen in FIG. 3. The edge 24 of core 16 projects outwardly between identical edges 32 of sheets 12 and 14 by about one-half inch. When adjacent panels are locked together edge 30 rides up and over ramp 38 and snaps into channel *or groove* 36 of edge 32. At the same time edges 22 and 24 of the core abut to form a tight insulating structure.

AS A RESULT OF REEXAMINATION, IT HAS BEEN DETERMINED THAT:

The patentability of claims 1–4 and 5 is confirmed.

New claims 6–35 are added and determined to be patentable.

*6. In a rigid building panel with substantially parallel planar front and rear metal sheets separated by an insulating rigid foam core bonded to the sheets and having a first pair of opposite parallel and substantially straight end edges, the improvements comprising*

*a second pair of opposite longitudinal edges having complimentary first and second interlocking elements forming the longitudinal edge of each metal sheet,*

*the first interlocking element forming a U-shaped projection along matching edges of the front and rear metal sheets spaced from the core to permit the U-shaped member to ride up independently from the core backed portion of the skin with a first core edge between the first interlocking elements having an inwardly projecting dish-shaped geometrical configuration,*

*the second interlocking element forming a ramp and a groove behind the ramp along matching edges of the front and rear metal sheets with a second core edge between the second interlocking elements having an outwardly projecting geometric shape conforming to the dish-shaped geometric configuration of the first core edge,*

*the first interlocking U-shaped projections on the second pair of edges of the metal sheets capable of riding up over the ramp of the second interlocking elements and snapping in place in the groove behind the ramp forming a tight interlock fit and forming an edge to edge insulating fit between the first and second core edges.*

*7. A rigid building panel according to claim 6, wherein the panel is snapped together with an adjacent panel in a channel affixed to a building overhead structure to form a ceiling.*

*8. A rigid building panel according to claim 6, wherein the panel is snapped together with an adjacent panel in a channel affixed to a building side wall structure to form an exterior wall.*

*9. A rigid building panel according to claim 6, wherein the metal sheets are light-weight aluminum.*

*10. A rigid building panel according to claim 6, wherein the core is an insulating styrofoam sheet.*

*11. In a rigid building panel with substantially parallel planar front and rear metal sheets separated by an insulating rigid foam core bonded to the sheets and having a first pair of opposite parallel and substantially straight end edges, the improvements comprising*

*a second pair of opposite longitudinal edges having complimentary first and second interlocking elements forming the longitudinal edge of each metal sheet,*

*the first interlocking element forming a U-shaped projection along matching edges of the front and rear metal sheets extending centrally toward an opposed first interlocking element and spaced from the core with a first core edge between the first interlocking elements having an inwardly projecting dish-shaped geometric configuration,*

*the second interlocking element forming a ramp and a groove behind the ramp along matching edges of the front and rear metal sheets with a second core edge between the second interlocking elements having an outwardly projecting geometric shape conforming to the dish-shaped geometric configuration of the first core edge,*

*the first interlocking U-shaped projections on the second pair of edges of the metal sheets capable of sliding over the ramp of the second interlocking elements and snapping in place in the groove behind the ramp forming a tight interlock fit and forming an edge to edge insulating fit between the first and second core edges.*

*12. A rigid building panel according to claim 11, wherein the panel is snapped together with an adjacent panel in a channel affixed to a building overhead structure to form a ceiling.*

*13. A rigid building panel according to claim 11, wherein the panel is snapped together with an adjacent panel in a channel affixed to a building side wall structure to form an exterior wall.*

*14. A rigid building panel according to claim 11, wherein the metal sheets are light-weight aluminum.*

*15. A rigid building panel according to claim 11, wherein the core is an insulating styrofoam sheet.*

*16. In a rigid building panel with substantially parallel planar front and rear metal sheets separated by an insulating rigid foam core bonded to the sheets and having a first pair of opposite parallel and substantially straight end edges, the improvements comprising,*

*a second pair of opposite longitudinal edges having complimentary first and second interlocking elements forming the longitudinal edge of each metal sheet,*

*the first interlocking element forming a U-*shaped projection along matching edges of the front and rear metal sheets, extending centrally toward an opposed first interlocking element with a first core edge between the first interlocking elements having an inwardly projecting dish-*shaped geometric configuration,*

*the second interlocking element forming a ramp and a groove behind the ramp along matching edges of the front and rear metal sheets with a second core edge*

*between the second interlocking elements having an outwardly projecting geometric shape conforming to the dish-shaped geometric configuration of the first edge,*

*said groove extending centrally from the front and rear metal sheets formed complimentary to and proportioned to nestingly receive the first U-shaped projections,*

*the first interlocking U-shaped projections on the second pair of edges of the metal sheets capable of sliding over the ramp of the second interlocking elements and snapping in place in the groove behind the ramp forming a tight interlock fit and forming an edge to edge insulating fit between the first and second core edges.*

*17. A rigid building panel according to claim 16, wherein the panel is snapped together with an adjacent panel in a channel affixed to a building overhead structure to form a ceiling.*

*18. A rigid building panel according to claim 16, wherein the panel is snapped together with an adjacent panel in a channel affixed to a building side wall structure to form an exterior wall.*

*19. A rigid building panel according to claim 16, wherein the metal sheets are light-weight aluminum.*

*20. A rigid building panel according to claim 16, wherein the core is an insulating styrofoam sheet.*

*21. In a rigid building panel with substantially parallel planar front and rear metal sheets separated by an insulating rigid foam core bonded to the sheets and having a first pair of opposite parallel and substantially straight end edges, the improvements comprising*

*a second pair of opposite longitudinal edges having complimentary first and second interlocking elements forming the longitudinal edge of each metal sheet,*

*the first interlocking element forming a U-shaped projection along matching edges of the front and rear metal sheets extending in spaced relationship from the core, and then essentially perpendicularly with the metal sheet from which it extends with a first core edge between the first interlocking elements having an inwardly projecting dish-shaped geometric configuration,*

*the second interlocking element forming a ramp and a groove behind the ramp along matching edges of the front and rear metal sheets with a second core edge between the second interlocking elements having an outwardly projecting geometric shape conforming to the dish-shaped geometric configuration of the first edge,*

*said groove extending substantially perpendicularly to the adjacent metal sheet and proportioned to nestingly receive the first U-shaped projection,*

*the first interlocking U-shaped projections on the second pair of edges of the metal sheets capable of sliding over the ramp of the second interlocking elements and snapping in place in the groove behind the ramp forming a tight interlock fit and forming an edge to edge insulating fit between the first and second core edges.*

*22. A rigid building panel according to claim 21, wherein the panel is snapped together with an adjacent panel in a channel affixed to a building overhead structure to form a ceiling.*

*23. A rigid building panel according to claim 21, wherein the panel is snapped together with an adjacent panel in a channel affixed to a building side wall structure to form an exterior wall.*

*24. A rigid building panel according to claim 21, wherein the metal sheets are light-weight aluminum.*

*25. A rigid building panel according to claim 21, wherein the core is an insulating styrofoam sheet.*

*26. In a rigid building panel with substantially parallel planar front and rear metal sheets separated by an insulating rigid foam core bonded to the sheets and having a first pair of opposite parallel and substantially straight end edges, the improvements comprising,*

*a second pair of opposite longitudinal edges extending centrally and perpendicularly to the front and rear sheets and having complimentary first and second interlocking elements forming the longitudinal edge of each metal sheet,*

*the first interlocking element forming a U-shaped projection along matching edges of the front and rear metal sheets spaced from the core and with a first core edge between the first interlocking elements having an inwardly projecting dish-shaped geometric configuration,*

*the second interlocking element forming a ramp and a groove behind the ramp along matching edges of the front and rear metal sheets with a second core edge between the second interlocking elements having an outwardly projecting geometric shape conforming to the dish-shaped geometric configuration of the first core edge,*

*the first interlocking U-shaped projections on the second pair of edges of the metal sheets capable of sliding over the ramp of the second interlocking elements and snapping in place in the groove behind the ramp forming a tight interlock fit and forming an edge to edge insulating fit between the first and second core edges.*

*27. A rigid building panel according to claim 26, wherein the panel is snapped together with an adjacent panel in a channel affixed to a building overhead structure to form a ceiling.*

*28. A rigid building panel according to claim 26, wherein the panel is snapped together with an adjacent panel in a channel affixed to a building side wall structure to form an exterior wall.*

*29. A rigid building panel according to claim 26, wherein the metal sheets are lightweight aluminum.*

*30. A rigid building panel according to claim 26, wherein the core is an insulating styrofoam sheet.*

*31. In a rigid building panel with substantially parallel planar front and rear metal sheets separated by an insulating rigid foam core bonded to the sheets and having a first pair of opposite parallel and substantially straight end edges, the improvements comprising*

*a second pair of opposite longitudinal edges extending centrally and perpendicularly from the front and rear sheets having complimentary first and second interlocking elements forming the longitudinal edge of each metal sheet,*

*the first interlocking element forming a U-shaped projection along matching edges of the front and rear metal sheets spaced from the core with a first core edge between the first interlocking elements having an inwardly projecting dish-shaped geometric configuration,*

*the second interlocking element forming a ramp and a U-shaped groove behind the ramp along matching edges of the front and rear metal sheets formed to receive the first interlocking element with a second core edge between the second interlocking elements having an outwardly projecting geometric shape conforming to the dish-shaped geometric configuration of the first core edge,*

*the first interlocking U-shaped projections on the second pair of edges of the metal sheets capable of sliding over the ramp of the second interlocking elements and snapping in place in the groove behind the ramp forming a tight interlock fit and forming an edge to edge insulating fit between the first and second core edges.*

*32. A rigid building panel according to claim 31, wherein the panel is snapped together with an adjacent panel in a channel affixed to a building overhead structure to form a ceiling.*

*33. A rigid building panel according to claim 31, wherein the panel is snapped together with an adjacent panel in a channel affixed to a building side wall structure to form an exterior wall.*

*34. A rigid building panel according to claim 31, wherein the metal sheets are lightweight aluminum.*

*35. A rigid building panel according to claim 31, wherein the core is an insulating styrofoam sheet.*

* * * * *